United States Patent [19]

Inoue et al.

[11] Patent Number: 4,671,220

[45] Date of Patent: Jun. 9, 1987

[54] FUEL SUPPLYING SYSTEM FOR INTERNAL COMBUSTION ENGINE

[75] Inventors: Seiji Inoue, Shizuoka; Hidekazu Takayasu, Hamamatsu, both of Japan

[73] Assignee: Sanshin Kogyo Kabushiki Kaisha, Hamamatsu, Japan

[21] Appl. No.: 751,685

[22] Filed: Jul. 3, 1985

[30] Foreign Application Priority Data

Jul. 23, 1984 [JP] Japan ..... 59-151358

[51] Int. Cl.[4] ..... F02B 33/04

[52] U.S. Cl. ..... 123/73 A; 261/34.2

[58] Field of Search ..... 261/34 A; 123/73 A, 123/73 R, 73 B

[56] References Cited

U.S. PATENT DOCUMENTS

| | | | |
|---|---|---|---|
| 2,824,725 | 2/1958 | Dietrich | 261/34 A |
| 3,198,187 | 8/1965 | Bartholomew | 261/34 A |
| 3,674,245 | 7/1972 | Massarotti | 261/34 A |
| 4,387,676 | 6/1983 | Couceiro | 261/34 A |
| 4,462,346 | 7/1984 | Haman et al. | 123/187.5 R |
| 4,483,292 | 11/1984 | Namba et al. | 123/308 |

FOREIGN PATENT DOCUMENTS

| | | | |
|---|---|---|---|
| 2041087 | 9/1980 | United Kingdom | 261/34 A |
| 2041089 | 9/1980 | United Kingdom | 261/34 A |

*Primary Examiner*—Craig R. Feinberg
*Assistant Examiner*—David A. Okonsky
*Attorney, Agent, or Firm*—Ernest A. Beutler

[57] ABSTRACT

Several embodiments of charge forming devices including improved accelerating pumps wherein the discharge of fuel from the accelerating pump is extended in time through the use of an accumulator chamber. In addition, the accelerating pump has an upstream and downstream discharge port. The accumulator chamber is also adapted to discharge fuel into the induction passage during extreme deceleration so as to improve engine running and prevent stalling under these circumstances.

30 Claims, 2 Drawing Figures

FUEL SUPPLYING SYSTEM FOR INTERNAL COMBUSTION ENGINE

BACKGROUND OF THE INVENTION

This invention relates to a fuel supplying system for an internal combustion engine and more particularly to an improved fuel supplying system for acceleration and deceleration conditions.

As is well known, a conventional charge former such as a carburetor incorporates an accelerating pump for discharging additional fuel into the induction passage during acceleration. This additional fuel discharge is provided so as to compensate for the greater inertia of fuel relative to air in changed air flow conditions. That is, when the engine begins to accelerate, the air flow will instantly increase but fuel flow will lag for some period of time due to its greater inertia. The accelerating pump is intended to provide additional fuel so as to make up for this lag. However, conventional accelerating pumps have a specific defect in that they tend to discharge too much of their fuel during the initial trottle opening acceleration condition and not enough at the end of the accelerating cycle. As a result, a large amount of fuel is injected initially at a time when the engine has not begun to accelerate and the air flow has not reached a quantity equivalent to the amount of fuel that is discharged. As a result, there is fuel wastage and poor fuel economy. Also, this tends to cause a leaner that desired mixture during the latter stage of acceleration and acceleration is not as smooth or as rapid as desired.

It is, therefore, a principal object of this invention to provide an improved accelerating system for the fuel discharge of a fuel supply system for an internal combustion engine.

It is a further object of this invention to provide a fuel supply system accelerating arrangement wherein the accelerating fuel flow more closely matches the acceleration of the associated engine.

The operation of the engine on deceleration and particularly during severe decelerations also presents some problems. These problems are again caused by the inertial effects and differences between the fuel and air mixture and the differences in rate of change of flow under transient conditions. These problems are particularly acute in two-cycle engines where the incoming fresh fuel/air mixture is employed to scavenge the residual gases from the combustion chamber. When the throttle valve is suddenly closed and the engine has been running at high speeds, the mixture in the combustion chamber is made up of a large part of residual exhaust gases and poor running and even stalling of the engine can result under extreme decelerations.

It is, therefore, a further object of this invention to provide an improved charge forming device for an internal combustion engine for improving performance under deceleration conditions.

It is another object of this invention to provide a device for supplying fuel to an internal combustion engine on deceleration.

SUMMARY OF THE INVENTION

A first feature of this invention is adapted to be embodied in a charge forming device for an internal combustion engine having a fuel source, an induction passage, a throttle valve in the induction passage for controlling the flow therethrough and an accelerating pump for pumping fuel from the fuel source in response to opening of the throttle valve. In accordance with this feature of the invention, first discharge means are provided for discharging fuel from the accelerating pump into the induction passage upstream of the throttle valve during at least a portion of the cycle of operation of the accelerating pump. Second discharge means are provided for discharging fuel from the accelerating pump into the induction passage downstream of the throttle during at least a portion of the cycle of the accelerating pump operation.

Another feature of the invention is also adapted to be embodied in a charge forming device for an internal combustion engine. The charge forming device according to this feature has an induction passage, a throttle valve for controlling the flow through the induction passage, a fuel source, a main fuel discharge for delivering fuel from the fuel source to the induction passage upstream of the throttle valve and an accumulator chamber in communication with the fuel source and adapted to contain a charge of fuel. Discharge means communicate the accumulator chamber with the induction passage downstream of the throttle valve for discharge of fuel from the accumulator chamber into the downstream portion of the induction passage.

DETAILED DESCRIPTION OF THE PREFERRED EMBODIMENTS

Figure 1:
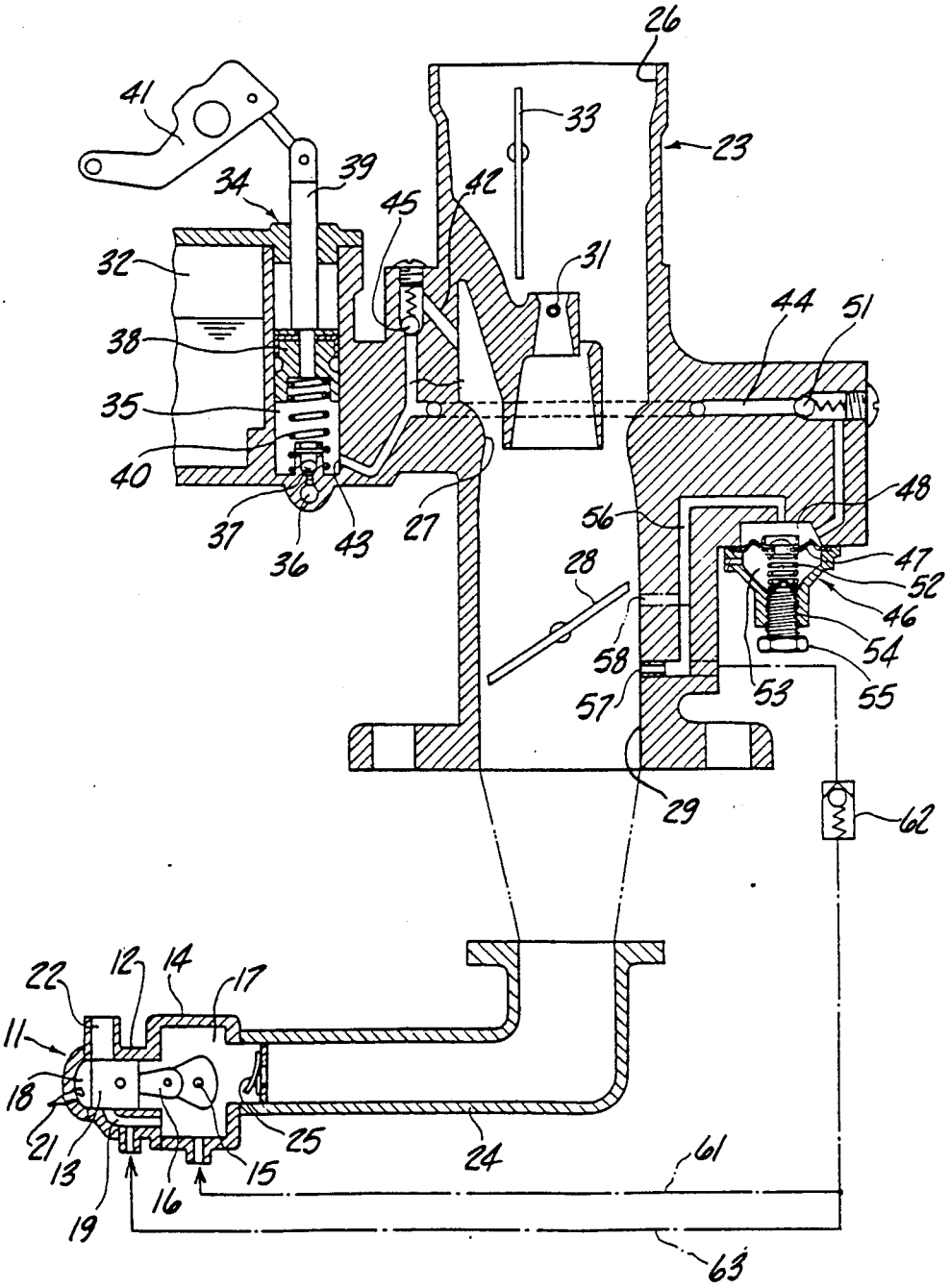
FIG. 1 is a cross-sectional view taken through a charge forming device constructed in accordance with an embodiment of the invention in association with an internal combustion engine, which is also shown in cross-section but on a smaller scale.

Referring first to FIG. 1, an internal combustion engine having a charge forming system constructed in accordance with this embodiment is identified generally by the reference numeral 11 with the engine being shown in cross-section and on a reduced scale. The engine 11 includes a cylinder block 12 having a cylinder bore in which a piston 13 is supported for reciprocation. At the base of the cylinder block 12, the engine 11 is provided with a crankcase 14 in which a crankshaft 15 rotates. The piston 13 is connected to the crankshaft 15 so as to drive it via a connecting rod 16.

The engine 11 is of the two-stroke, crankcase compression type and for this reason the crankcase 14 is provided with a sealed chamber 17 beneath the piston 13. A fuel/air charge is admitted to the crankcase chamber 17, in a manner to be described, and is compressed by the downward movement of the piston 13. As the fuel/air charge is compressed, it is transferred to a combustion chamber 18 formed above the piston 13 through one or more scavenge passages 19. The charge is fired in the combustion chamber 18 by means of a spark plug 21 and the burnt charge is then exhausted through an exhaust port 22.

The fuel/air charge is delivered to the crankcase chamber 17 from a charge forming device or carburetor 23 via an intake manifold 24 and reed type check valve 25. The check valve 25 insures against significant back flow from the crankcase 17 into the manifold 24 and curburetor 23. The engine as thus far described may be considered to be conventional and, for that reason, the details regarding its construction have not been illustrated and further description of them is believed to be unnecessary.

The carburetor 23 is comprised of a main body that defines an air inlet or air horn 26 and an induction passage communicating therewith including a venturi section 27. A throttle valve 28 is positioned in this induction passage downstream of the venturi section 27 for controlling the flow therethrough. Below the throttle valve 28, the induction passage is formed with an outlet 29 that communicates with the inlet to the manifold 24.

A main boost nozzle 31 is positioned in the induction passage in proximity to the venturi section 27. Fuel is delivered to the main fuel nozzle 31 from a fuel bowl 32 in which fuel is maintained at a uniform head by a float operated valve in a known manner. The fuel discharge circuit of the main fuel system including the nozzle 31 may be considered to be conventional and, for that reason, it has not been illustrated and will not be described in any more detail.

A choke valve 33 is provided in the air horn 26 for restricting the air flow through it and providing an enriched starting mixture. The choke valve 33 may be manually or automatically operated.

The carburetor 23 is provided with an accelerating pump, indicated generally by the reference numeral 34, which includes a pumping chamber or well 35 formed in the body of the curburetor 23. Fuel flows into the pumping chamber 35 from the fuel bowl 32 through an inlet orifice 36 in which a one-way check valve 37 is provided.

A piston type pump 38 is slidably supported within the well 35 and is connected to a link 39 which is, in turn, operated by an accelerating pump lever 41 that is connected to the throttle linkage so as to be operated simultaneously with movement of the throttle valve 28 in any of the known manners. The piston 38 is normally urged to a retracted position by means of a coil compression spring 40 that is contained within the pumping chamber 35.

The accelerating pump 34 has a normal main discharge circuit including a pump shooter or discharge nozzle 42 that is positioned in the air horn 26 upstream of the venturi section 27 and in proximity to the main discharge nozzle 31. A pump outlet 43 is formed at the bottom of the pumping chamber 35 and communicates with a passageway 44 for delivering fuel from the pumping chamber 35 to the shooter or nozzle 42. A ball type check valve 45 is positioned in the body and will preclude the discharge of fuel from the nozzle or shooter 42 under high vacuum conditions and unless the piston 38 has been actuated. The check valve 45 serves the main purpose of preventing the discharge of fuel except when the accelerating pump 34 is operated so that fuel will not be drawn through the nozzle 42 during normal running conditions or under accelerations.

The construction of the carburetor 23 as thus far described is conventional. In accordance with the invention, the accelerating pump discharge circuit is provided with a further discharge in which an accumulator chamber, indicated generally by the reference numeral 46, is provided. The accumulator chamber 46 includes a diaphragm 47 that is clamped to the underside of the main curburetor body by means of a lower housing member. The diaphragm 47 defines an upper accumulator chamber 48 that communicates with a conduit 49 that extends from the accelerating pump discharge circuit 44 and in which a check valve 51 is provided so as to permit flow from the passage or conduit 49 into the chamber 48 but prevent flow in a reverse direction.

The diaphragm 47 is normally urged to an at rest position by means of a coil compression spring 52 that is contained within an atmospheric chamber 53 formed on the underside of the diaphragm 47. An adjustable stop 54 is provided for the diaphragm 47 which is held in place by a jam nut 55.

The accumulator 44 is provided with a discharge circuit that includes a passageway 56 that extends from the chamber 48 to a point downstream of the idle position of the throttle valve 28. Such a discharge point is indicated by the discharge port 57 that is positioned substantially downstream of the idle positon of the throttle valve 28 and adjacent the carburetor outlet 29. Alternatively-or additionally, there may be a discharge port 58 positioned closely adjacent the idle position of the throttle valve 28 and in proximity to the normal idle and transition discharge ports (not shown) of the carburetor 23. These idle and transition discharge ports and the fuel circuits associated with them are not illustrated since they may be conventional in construction.

The portion of the carburetor 23 as thus far described and its cooperation with the engine 11 will now be described. The carburetor serves the intake manifold 24 and crankcase chamber 17 in a conventional manner for individual settings of the throttle valve 28. That is, under high speed running, when the throttle valve 28 is substantially fully open, the fuel/air mixture will be supplied from the fuel bowl 32 through the main discharge nozzle 31. Alternatively, when the throttle valve 28 is positioned in its idle position or off idle position, the fuel/air mixture will be supplied primarily from the idle and transition discharge circuits which are not shown but which have already been described.

When the throttle valve 28 is in its idle condition, the link 41 acting through the piston rod 39 will have drawn the piston 38 upwardly so as to fill the accelerating pump well 35 from the passage 36 and check valve 37. If the throttle valve 28 is then rapidly opened, the link 41 will rotate and move the piston rod 39 and piston 38 downwardly. This downward movement will cause the fuel to be expelled from the well 35 into the conduit 44. The pressure rise in the passage 44 will unseat the check valve 45 and cause fuel to be discharged through the accelerating pump discharge nozzle 42.

At the same time, the passage 49 will be pressurized and the check valve 51 will open. Fuel can then flow into the accumulator chamber 48 by forcing the diaphragm 47 downwardly against the action of the spring 52. Some fuel will also be delivered to the passageway 56 but this fuel will not be discharged until the accumulator chamber 48 reaches its full capacity as determined by the contact of the plunger with the adjustable stop 54.

Thus, during the initial operation of the accelerating pump 34, there will be discharge from the nozzle 42 only. However, after the accumulator chamber 48 has been filled, if there is still fuel being discharged by the accelerating pump 34, it will flow either or both of the discharge nozzles 58 and 57 as they may be provided as well as through the nozzle 42. After the pump 34 has completed its stroke, the spring 52 and action of the diaphragm 47 will cause the chamber 48 to again contract and additional fuel will be discharged through the nozzles 57 and/or 58. Hence, the time of discharge of the accelerating pump 34 is extended by use of the accumulator 44 and further the later delivered fuel will be delivered downstream of the throttle valve 28.

As has been previously noted, engines tend to run roughly on deceleration and can tend to stall due to insufficient fuel flow to the engine. This problem is particularly acute with respect to two-cycle engines. In order to improve this running characteristic, a conduit 61 extends from the conduit 56 to a port feeding into the crankcase 17. A pressure responsive check valve 62 is provided in this conduit which is adapted to open when high vacuums are exerted. Thus, when the throttle valve 28 is rapidly closed and the engine is still decelerating there will be sufficient vacuum generated so as to cause the check valve 62 to open and fuel may be drawn from the accumulator chamber 48 through the line 61 into the crankcase 17. This will provide sufficient enrichment on deceleration to permit smooth running. Alternatively, a line 63 may extend from the conduit 58 directly to the scavenge passage 19 or both the lines 61 and 63 may be employed.

The fuel under deceleration within the chamber 48 may be depleted by upward movement of the diaphgram 47 to diminish the volume of the chamber 48. This fuel will be replaced during the next opening of the throttle valve 28 and operation of the accelerating pump 34.

Figure 2:
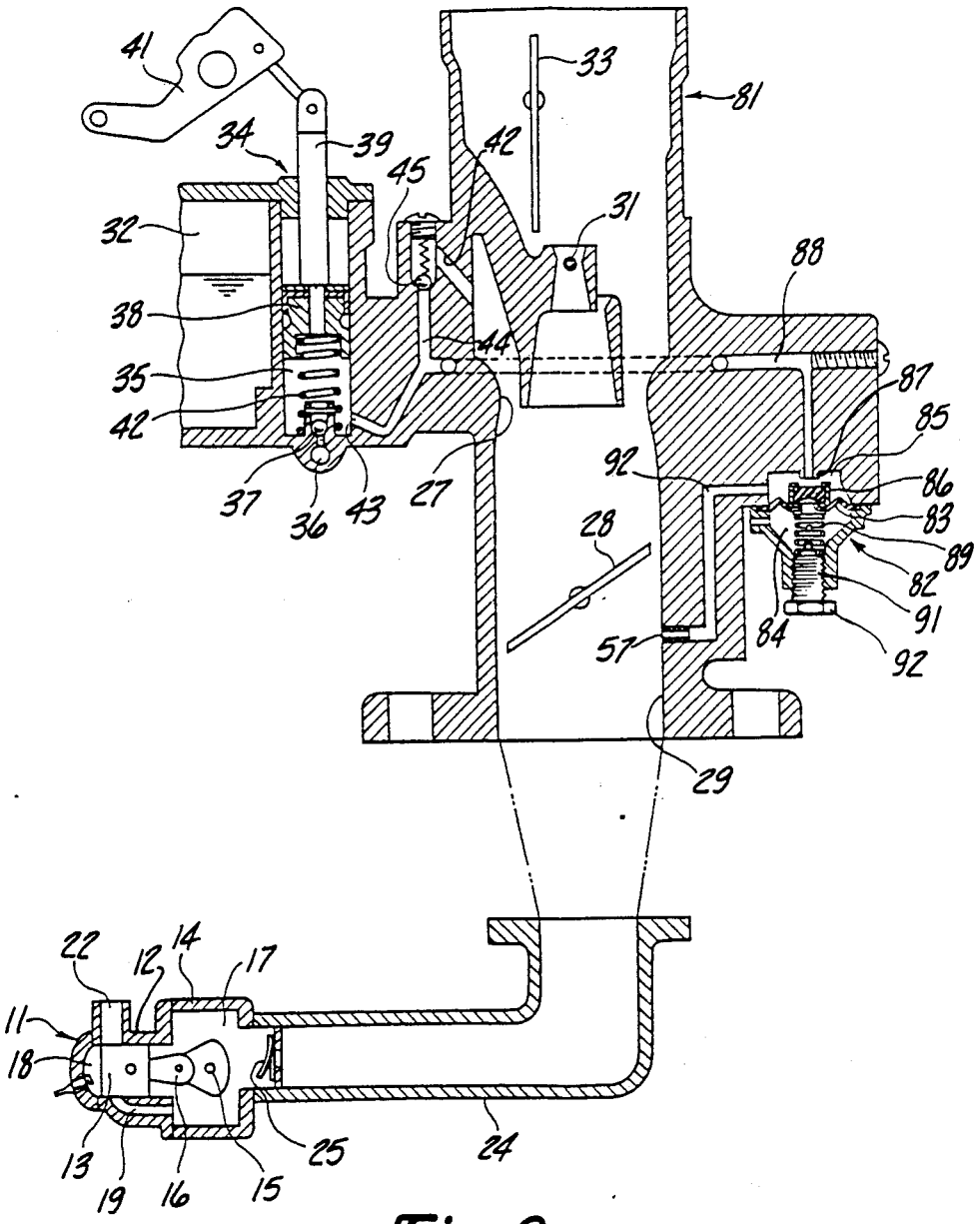
FIG. 2 is a cross-sectional view, similar to FIG. 1, showing another embodiment of the invention.

FIG. 2 illustrates another embodiment of the invention wherein a charge forming device constructed in accordance with this embodiment is identified generally by the reference numeral 81. This embodiment differs from the embodiment of FIG. 1 only in the construction of the accumulator device and the manner in charging it. For this reason, all components of the engine and carburetor which are the same as the previously described embodiment have been identified by the same reference numeral and will not be described again in detail, except insofar as is necessary to understand the construction and operation of this embodiment.

An accumulator device, indicated generally by the reference numeral 82, is provided on one side of the carburetor body and includes a diaphragm 83 that divides the internal chamber into an atmospheric portion 84 and an accumulator portion 85. In this embodiment, the center portion of the diaphragm 83 carries a valve seat 86 that is adapted to engage a port 87 formed at one end of a passage 88 that intersects the accelerating pump passage 44. It should be noted that the passage 88 does not include a check valve like the check valve 51 of the previously described embodiment.

In this embodiment, a coil compression spring 89 acts against the underside of the diaphragm 83 and normally urges the seat 86 into engagement with the port 87 so as to preclude communication of the passage 88 with the accumulator chamber 85.

As with the embodiment of FIG. 1, an adjustable stop 91 is provided which is locked in place by a jam nut 92 so as to limit the degree of downward movement of the diaphragm 83.

A passage 92 extends from the accumulator chamber 85 to the discharge port 57. Alternatively, the discharge ports 58 or the conduits 61 and 63 and the check valve 62 of the previously described embodiment may be utilized in conjunction with the accumulator and internal check valve of this embodiment.

This embodiment works in the following manner. When the accelerating pump 34 has been charged with fuel and the throttle valve 28 is suddenly opened, the initial fuel displaced from the accelerating pump well 35 will again be delivered past the check valve 45 to the accelerating pump nozzle 42. The action of the spring 89 on the valve member 86 will prevent the initial flow of fuel into the accumulator chamber 85. However, once the accelerating pump piston 38 has begun its downward stroke, the check valve provided by the valve member 86 and coil spring 89 will open and fuel will be delivered to the accumulator chamber 85. A portion of this fuel may flow into the conduit 92 but no significant discharge will take place until the diaphragm 83 has completed its downward stroke and engage the adjustable stop 91. At that time, the spring 89 will return the diaphragm 83 upwardly and displace fuel through the conduit 92 and its respective discharge nozzles or ports 57.

When the valve 86 is in engagement with the port 87, there will still be fuel in the accumulator chamber 85. Under severe decelerations, there will be sufficient pressure generated so as to overcome the internal spring action of the diaphragm 83 and it will deflect upwardly so as to permit fuel to flow out the port 57 during these extreme decelerations thus employing the same advantages as the previously described embodiment.

In view of the foregoing, it is believed readily clear to those skilled in the art that an improved device is provided which will prolong the discharge of accelerating fuel and which will also permit the enrichment of the fuel flow during extreme deceleration conditions so as to permit better engine running under these conditions. Although several embodiments of the invention have been illustrated and described, various changes and modifications may be made without departing from the spirit and scope of the invention, as defined by the appended claims.

We claim:

1. In a charge forming device for an internal combustion engine having a fuel source, an induction passage, a throttle valve in said induction passage for controlling the flow therethrough, and an accelerating pump operable through a charging stroke and a discharging stroke for pumping fuel from said fuel source in response to opening of said throttle valve, the improvement comprising first discharge means for discharging fuel from said accelerating pump into said induction passage upstream of said throttle valve during at least a portion of the discharging stroke of said accelerating pump, and second discharge means for discharging fuel from said accelerating pump into said induction passage downstream of said throttle valve during at least another portion of the discharging stroke of said accelerating pump.

2. In a charge forming device as set forth in claim 1 wherein the fuel is discharged from the second discharge means at the end of the stroke of the accelerating pump.

3. In a charge forming device as set forth in claim 1 wherein the second discharge means discharges into the induction passage immediately adjacent the downstream position of the throttle valve when the throttle valve is in its idle position.

4. In a charge forming device as set forth in claim 1 wherein the second discharge means discharges into the induction passage in proximity to the associated engine.

5. In a charge forming device as set forth in claim 4 wherein the engine is a two-cycle crankcase compression engine and the second fuel discharge means discharges into the crankcase.

6. In a charge forming device as set forth in claim 1 wherein the charge forming device comprises a carburetor having a main fuel discharge for discharging fuel from the fuel source into the induction passage upstream of the throttle valve.

7. In a charge forming device as set forth in claim 6 wherein the fuel is discharged from the second discharge means at the end of the stroke of the accelerating pump.

8. In a charge forming device as set forth in claim 7 further including means for prolonging the discharge of fuel from the second fuel discharge means after the accelerating pump completes its stroke.

9. In a charge forming device as set forth in claim 8 wherein the means for prolonging the discharge comprises an accumulator chamber means.

10. In a charge forming device as set forth in claim 9 wherein the engine is a two-cycle crankcase compression engine and the second fuel discharge means discharges into the crankcase.

11. In a charge forming device as set forth in claim 9 wherein the associated engine is a crankcase compression two-cycle internal combustion engine having a scavenge passage extending between the crankcase and the combustion chamber for transferring a charge thereto and the second fuel discharge means discharges into the scavenge passage.

12. In a charge forming device for an internal combustion engine having a fuel source, an induction passage, a throttle valve in said induction passage for controlling the flow therethrough, and an accelerating pump for pumping fuel from said fuel source in response to opening of said throttle valve, the improvement comprising first discharge means for discharging fuel from said accelerating pump into said induction passage upstream of said throttle valve during at least a portion of the cycle of operation of said accelerating pump, second discharge means for discharging fuel from said accelerating pump into said induction passage downstream of said throttle valve during at least a portion of the cycle of operation of said accelerating pump, and means for prolonging the discharge of fuel from said second fuel discharge means after said accelerating pump completes its stroke.

13. In a charge forming device as set forth in claim 12 wherein the means for prolonging the discharge comprises an accumulator chamber means.

14. In a charge forming device as set forth in claim 12 wherein the second discharge means discharges into the induction passage immediately adjacent the downstream position of the throttle valve when the throttle valve is in its idle position.

15. In a charge forming device for a crankcase compression two-cycle internal combustion engine having a scavenge passage extending between the crankcase and the combustion chamber for transferring a charge thereto for an internal combustion engine having a fuel source, an induction passage, a throttle valve in said induction passage for controlling the flow therethrough, and an accelerating pump for pumping fuel from said fuel source in response to opening of said throttle valve, the improvement comprising first discharge means for discharging fuel from said accelerating pump into said induction passage upstream of said throttle valve during at least a portion of the cycle of operation of said accelerating pump, second discharge means for discharging fuel from said accelerating pump into said induction passage downstream of said throttle valve during at least a portion of the cycle of operation of said accelerating pump, and said second fuel discharge means discharges into said scavenge passage.

16. A charge forming device for an internal combustion engine having an induction passage, a throttle valve for controlling the flow through said induction passage, a fuel source, a main fuel discharge for delivering fuel from said fuel source to said induction passage upstream of said throttle valve, an accumulator chamber in communication with said fuel source and adapted to retain a predetermined charge of fuel, and discharging means responsive to deceleration for communicating said accumulator chamber with said induction passage downstream of said throttle valve in resposne to a deceleration and during such deceleration for discharging said predetermined charge of fuel.

17. A charge forming device as set forth in claim 16 wherein the accumulator chamber includes a flexible diaphragm having sufficient resilience to resist deflection thereof until a predetermined vacuum exists.

18. A charge forming device as set forth in claim 16 wherein the discharging means is positioned immediately adjacent the downstream side of the throttle valve.

19. A charge forming device as set forth in claim 16 wherein the engine is a two-cycle crankcase compression engine and the discharge means discharges into the crankcase.

20. A charge forming device as set forth in claim 16 further including means for charging the accumulator chamber upon the opening of the throttle valve.

21. In a charge forming device as set forth in claim 16 further including means including one way check valve means for charging said accumulator chamber from said fuel source, said one way check valve means precluding flow from said fuel source to said accumulator chamber in response to induction system vacuum.

22. In a charge forming device as set forth in claim 21 wherein the means for charging the accumulator chamber includes an accelerating pump operated by movement of the throttle valve, said one way check valve means being interposed between said accelerating pump and said accumulator chamber.

23. A charge forming device for a crankcase compression two-cycle internal combustion engine having a scavenge passage extending between the crankcase and the combustion chamber for transferring a charge thereto said charge forming device having an induction passage, a throttle valve for controlling the flow through said induction passage, a fuel source, a main fuel discharge for delivering fuel from said fuel source to said induction passage upstream of said throttle valve, an accumulator chamber in communication with said fuel source and adapted to contain a charge of fuel, and discharging means for communicating said accumulator chamber with said scavenge passage.

24. A charge forming device for an internal combustion engine having an induction passage, a throttle valve for controlling the flow through said induction passage, a fuel source, a main fuel discharge for delivering fuel from said fuel source to said induction passage upstream of said throttle valve, an accumulator chamber in communication with said fuel source and adapted to contain a charge of fuel, means for charing said accumulator chamber with fuel upon the opening of said throttle valve, and discharging means for communicating said accumulator chamber with said induction passage downstream of said throttle valve, said discharge means providing means for discharging a predetermined amount of fuel immediately upon the cessation of charging of said accumulator chamber and for discharging the remainder of the fuel under extreme deceleration conditions.

25. A charge forming device for a two-cycle crankcase compression internal combustion engine having an induction passage, a throttle valve for controlling the flow through said induction passage, a fuel source, a main fuel discharge for delivering fuel from said fuel source to said induction passage upstream of said throttle valve, discharge means being positioned immediately adjacent the downstream side of the throttle valve for communicating fuel from said fuel source with said induction passage downstream of said throttle valve and also communicating fuel with said crankcase, a scavenge passage extending between the crankcase and the combustion chamber for transferring a charge thereto and the discharge means further discharging into the scavenge passage, and means for providing for discharge of fuel from said discharge means to the respective passage, crankcase and scavenge passage only during decelerations.

26. A charge forming device as set forth in claim 25 further including an accumulator chamber interposed between the fuel source and the discharge means for providing fuel to the discharge means.

27. A charge forming device as set forth in claim 26 wherein the accumulator chamber further includes valve means for controlling the flow of fuel into the accumulator chamber wherein only a certain volume of fuel will be discharged from the discharge means upon declerations.

28. A charge forming device as set forth in claim 27 wherein the discharge means is positioned immediately adjacent the downstream side of the throttle valve.

29. A charge forming device as set forth in claim 27 wherein the engine is a two-cycle crankcase compression engine and the discharge means discharges into the crankcase.

30. A charge forming device as set forth in claim 27 wherein the associated engine is a crankcase compression two-cycle internal combustion engine having a scavenge passage extending between the crankcase and the combustion chamber for transferring a charge thereto and the discharge means discharges into the scavenge passage.

* * * * *